US006152112A

United States Patent [19]

Coppola

[11] Patent Number: 6,152,112

[45] Date of Patent: Nov. 28, 2000

[54] FUEL JUMPER LINE ASSEMBLY

[76] Inventor: Edoardo Coppola, 6267 Majorca Cir., Long Beach, Calif. 90803

[21] Appl. No.: 09/368,315

[22] Filed: Aug. 3, 1999

[51] Int. Cl.[7] ..... F02M 37/04

[52] U.S. Cl. ..... 123/468; 123/469

[58] Field of Search ..... 123/468, 469, 123/470

[56] References Cited

U.S. PATENT DOCUMENTS

| | | | |
|---|---|---|---|
| 3,402,703 | 9/1968 | Dickerson et al. | 123/468 |
| 3,845,748 | 11/1974 | Eisenberg | 123/470 |
| 5,617,828 | 4/1997 | Kuegel et al. | 123/468 |
| 5,775,302 | 7/1998 | Guido et al. | 123/468 |
| 5,979,416 | 11/1999 | Berger | 123/468 |

*Primary Examiner*—Thomas N. Moulis
*Attorney, Agent, or Firm*—Marcia Devon; Chan Law Group LC

[57] ABSTRACT

A diesel engine fuel jumper line assembly is disclosed which provides both improved performance and ease in manufacturing. The fuel jumper line forms a loop with the fuel injector and the fuel manifold/engine block. There is an improved connection between the injector and the fuel jumper lines with positive sealing which provides for substantially enhanced sealing and more effective maintenance. The novel sealing design eliminates the prior metal-to-metal seal and has chamfer-shaped fittings. A reinforced connection in which the fuel manifold is bolted to the fuel line jumper block is also provided, which prevents fuel leaking and mixing with the lubrication oil as well as preventing lubricating oil leaking outside of the engine through the bolt hole.

10 Claims, 3 Drawing Sheets

FUEL JUMPER LINE ASSEMBLY

FIELD OF THE INVENTION

The invention pertains to fuel injectors for internal combustion engines, particularly diesel engines on railroad trains, transit lines, marine and power generators.

BACKGROUND OF INVENTION

Diesel fuel injectors are subject to heavy and repeated use and must be designed for large variations in temperature and by necessity operate under high pressure, as well as continuous vibration. One major problem with the fuel injectors is fuel and oil leaks at the connection of the fuel jumper line to the engine's fuel manifold. In prior designs, leaks were prevalent due to the engine vibration which caused the parts sealing the fuel jumper line, particularly at the washer, and other connections, to deteriorate, lose torque and to leak, where the fuel line is mounted to the exterior portion of the fuel manifold. Another point of contact where leakage occurred is where the fuel jumper block attaches to the fuel line manifold. In conventional designs, all of the components at the fuel line jumper block to engine manifold are connected essentially by one bolt, which when loosened, causes leakage.

Leaks typically occur where the ends of the fuel jumper line are affixed to the fuel manifold on the one end and the injector body on the opposite end. Leaks occur where the bolt secures the fuel line manifold to the fuel line jumper block and where the fuel line fitting is affixed to the fuel line manifold. Finally, leaks also occur where the filter cap of the fuel jumper line is affixed to the injector body.

The present invention is designed to provide substantially improved sealing to prevent leakage. The present invention provides a controlled seal avoiding the metal-to-metal seal of conventional designs. The present invention also has a connector which is shaped to permit the use of a rubber sealing ring to further enhance the sealing ability.

SUMMARY OF INVENTION

The present invention includes connecting the two fuel jumper lines to the injector body utilizing a chamfer fitting which connects to the two openings in the injector body. The opening, or filter cap portion of the connection is cone-shaped. The chamfer fitting is thus tightly seated in the conical filter cap because they are the same conical shape. Each fuel jumper line includes an integrated chamfer fitting with an O-ring. The chamfer fitting with the O-ring fits into the conical filter cap for enhanced or positive sealing.

The opposing end of the fuel jumper lines are connected to the fuel manifold with the same chamfer fittings inserted into threaded cone-shaped openings. The chamfer fittings of the opposing end of the fuel jumper lines also includes rubber O-rings for positive sealing. The positive sealing feature is critical because poor sealing causes the diesel fuel to leak inside the engine.

The fuel jumper lines are inserted through the fuel line jumper block before insertion into the cone-shaped openings of the fuel manifold. The fuel line jumper block includes a threaded opening in the center to receive a large bolt. A large, threaded bolt connects the engine manifold to the fuel manifold as well as the fuel line jumper block. In addition to the bolt, additional sealing elements are provided. An integrated sealing washer is provided, which is a flat steel washer with a ring made of rubber (or similar material) molded to its inside diameter. The rubber ring, when clamped by the steel washer provides positive sealing between the engine block surface, and the bolt. The sealing elements further include another flat steel washer, a beveled washer and a mounting bolt. The convex side of the beveled washer faces towards the bolt head for improved sealing and is flattened as torque is applied to the bolt and the bolt is tightened. The improved connection is crucial because inadequate sealing causes lubrication oil to leak outside the engine and mix with the fuel which reduces the viscosity of the oil.

DESCRIPTION OF THE PREFERRED EMBODIMENT

Figure 1:
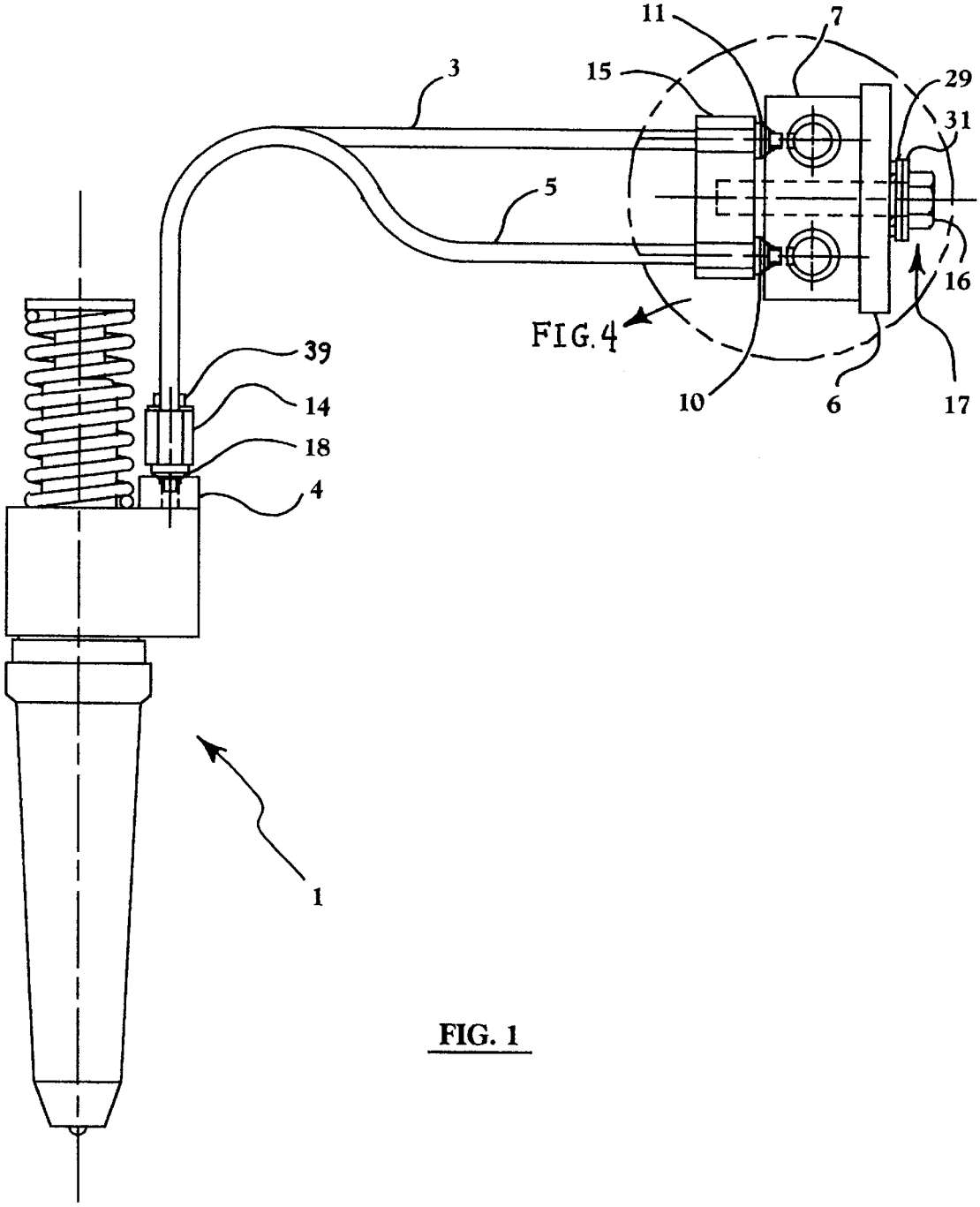
FIG. 1 shows the assembled fuel jumper line assembly including a side view of the fuel injector as connected to the fuel line jumper lines, fuel line manifold and engine block and includes a cross-sectional view of the fuel jumper block to engine block and fuel manifold.

The fuel injector is connected to the engine at six different locations. The fuel jumper lines form a loop connecting the injector and the engine block. Referring to FIG. 1, there are two fuel jumper lines 3 and 5 connected on one end to the injector 1 and on the other end to the engine block 6. The improved connection between the fuel jumper lines to the fuel manifold and engine block includes a (truncated) coned-shaped fittings 10 and 11. The cone-shaped fitting 11 is inserted into the chamfer walls 12 [best seen in FIG. 3] and the cone-shaped fitting 10 is inserted into the chamfer wall 13 [FIG. 4] formed in the fuel line manifold 7. The tolerance for the chamfer diameter can be substantial without causing fuel leakage in that location and the design makes the mass production of the parts easier than with conventional designs.

Figure 2:
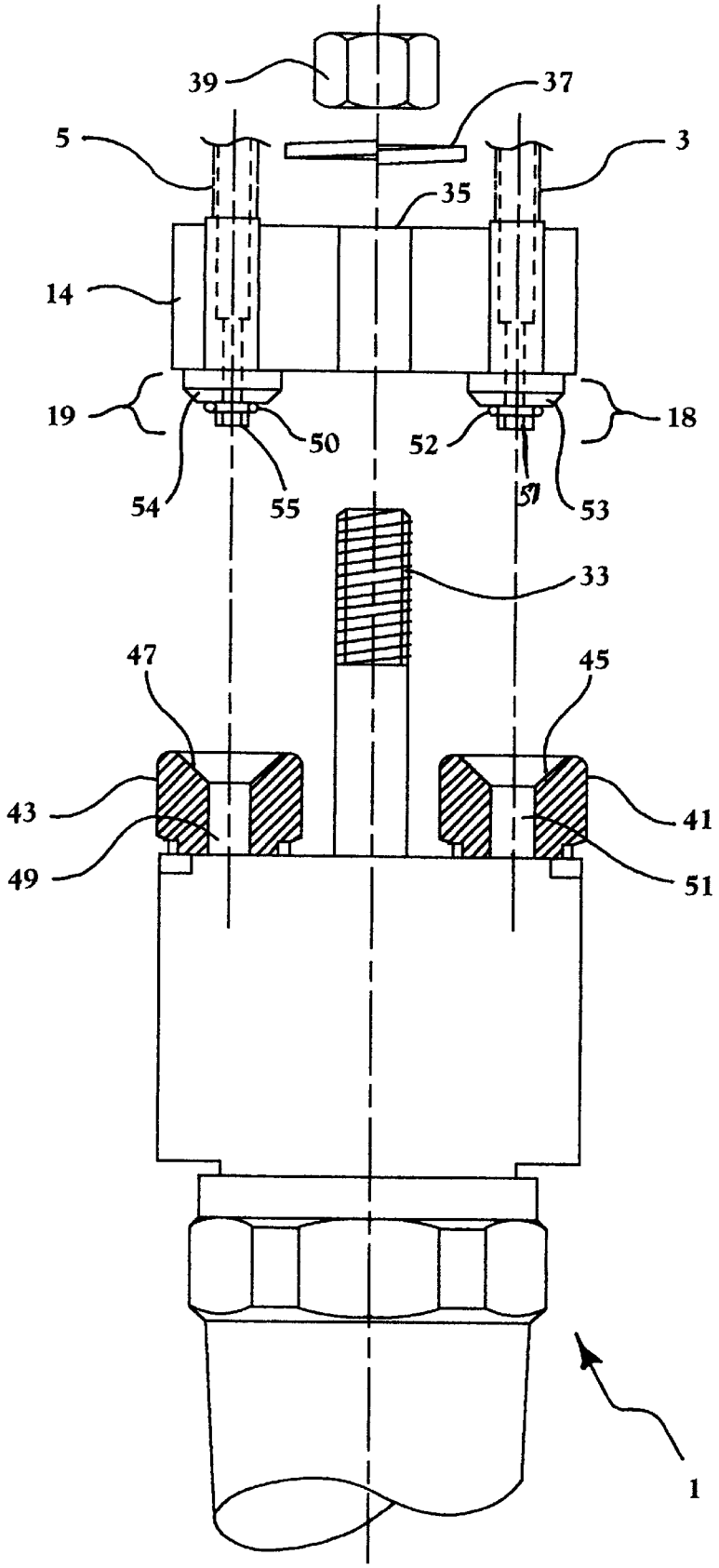
FIG. 2 is an exploded cross-sectional view showing the connections between the injector body and the fuel jumper lines with the inside diameters of the jumper lines shown in phantom lines.
Figure 3:
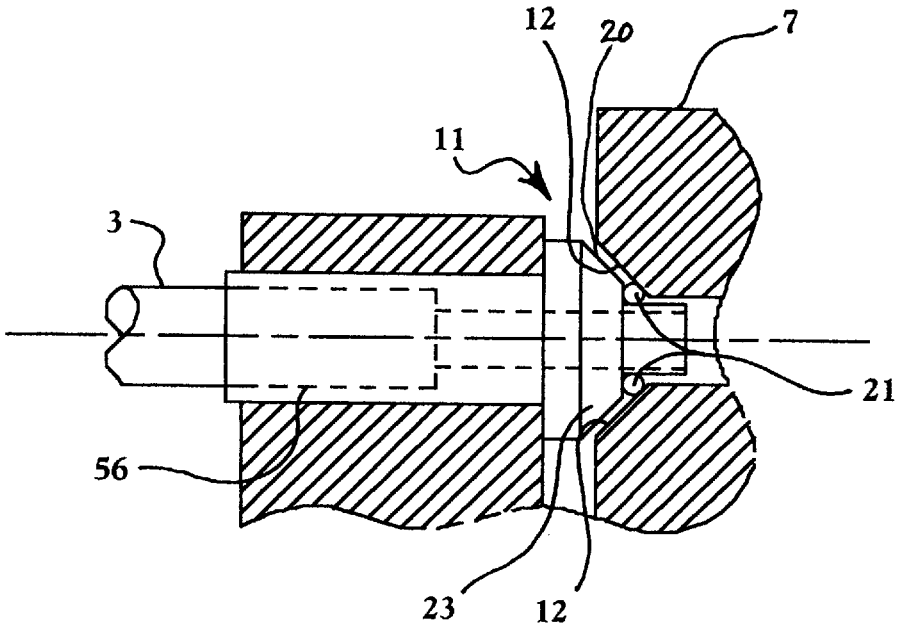
FIG. 3 is an enlarged cross-sectional view of the fuel jumper block-to-engine manifold connection with the inner diameter of the fuel jumper line shown in phantom lines.
Figure 4:
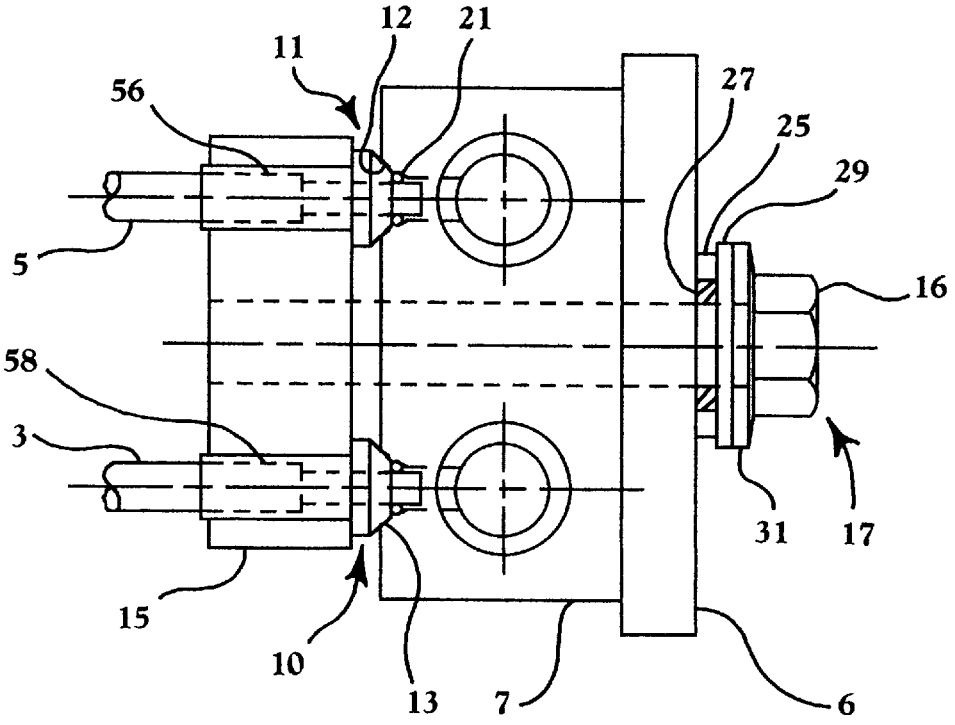
FIG. 4 is a enlarged cross-sectional view of a portion of FIG. 1 showing the connections of the fuel jumper line to the manifold with the inner diameters of the fuel jumper lines and the bolt stem shown in phantom lines.

The cone-shaped fittings 10, 11, [best seen in FIGS. 3 and 4], 18 and 19 [shown in FIG. 2], have additional features to enhance the sealing properties. Each fitting includes an integral connector and a rubber O-ring. For example, as shown in FIG. 3, the fitting 11 includes an integral connector 20 and a rubber O-ring 21 which provide additional or positive sealing. The fittings used in the prior art designs could not accommodate the rubber O-ring which contributed to the poor sealing characteristics of the prior designs.

FIG. 3 shows the fitting 11 and the chamfer walls 12 of the fuel manifold 7 just prior to the completed connection. When the fitting is completely inserted, the fitting 11 is in contact with the chamfer walls 12.

Referring to FIG. 1, as well as FIGS. 2 and 4, the fuel jumper lines 3 and 5 are inserted through openings in the fuel line jumper blocks 14 and 15. One jumper block (14) is located on the injector side of the loop, while jumper block 15 is on the engine block side. The fuel manifold 7 and the jumper lines 3 and 5 are connected to the engine block with a mounting bolt 17 and a number of additional sealing members.

The additional sealing members of the improved sealing design include an integrated sealing washer 25 with a rubber O-ring 27, a flat steel washer 29 and a beveled washer 31. The beveled washer 31 has the convex portion placed toward the hexagonal bolt head 16. The beveled washer 31 is flattened as torque is applied and the bolt 17 is tightened in place.

Prior designs made maintenance more difficult and less effective than the positive seal of the present invention. The metal-to-metal contact of the prior art fittings caused the fitting to wear more rapidly than with the present invention, which has rubber-to-metal contact. Moreover, when the fittings required replacement, the fitting required more stringent tolerances because the male fitting had to seat precisely the same as the worn-out male fitting which was being replaced. The prior art fitting was analogous to a footprint, in which "the foot" or fitting had to be precisely matched to "the footprint" or chamfer wall in order to seal effectively. When the fittings of the present invention require replacement, a new rubber O-ring is simply exchanged for the old one. For example, the O-ring 50, shown in FIG. 2, can be removed and a replacement O-ring placed over the end 55 of the jumper line 5.

Referring to FIG. 2, which shows the connection between the injector body and the fuel jumper lines, the threaded injector stud 33 is inserted through the opening 35 of fuel line jumper block 14. The injector stud 33 is fastened with a lock washer 37 and preferably, a hexagonal nut 39, although a number of different types of nuts, e.g. allen nuts or square nuts, will also suffice.

With continued reference to FIG. 2, the fuel jumper lines 3 and 5 are inserted into the filter caps 41 and 43. The filter caps 41 and 43 are formed with female chamfer walls 45 and 47 at the upper portion of cylindrical walls 49 and 51 to receive the conical fittings 18 and 19. A positive seal is created with rubber (or similar material) O-rings 50 and 52 when they are compressed between: a) the chamfer walls 45 and 47, b) the bottom flat surface of the chamfered portions 53 and 54 of jumper lines 18 and 19, and c) the walls of the cylindrical ends 55 and 57 of the jumper lines 18 and 19.

The fuel is delivered from the fuel manifold 7 through the fuel jumper lines 3 and 5, their respective fittings 11 and 10 on the engine manifold side, through the fittings 19 and 18 on the injector side, and into the fuel injector itself for delivery to the combustion chamber. The inside diameters 56 and 58 of the fuel jumper lines are shown with phantom lines in FIGS. 3 and 4.

It will be appreciated that one skilled in the art easily ascertain the essential characteristics of the invention, including being used with different types of devices and alternate parts, without departing from the spirit and scope of the invention, and make various changes and modifications to adapt it to various uses.

I claim:

1. A fuel line jumper assembly for use with a fuel injector and internal combustion engine block having a fuel manifold, said assembly comprising:

at least one fuel jumper line connected to at least one fuel jumper block;

means for fastening said fuel injector to said fuel jumper block, said fuel jumper block having an opening to receive said fuel jumper lines;

at least one set of first and second cone-shaped fittings including compressible rings, said fittings formed at each opposing ends of each of said fuel jumper lines;

chamfer-shaped walls forming an opening in the fuel injector to receive said first cone-shaped fitting;

chamfer-shaped wall forming an opening in said fuel manifold to receive said second cone-shaped fitting; and means for connecting said engine block and said fuel manifold to said fuel jumper block wherein each of said rings are compressed between said respective first and second cone-shaped fittings and said chamfer-shaped walls in said injector and said fuel manifold, thereby forming a seal with fuel flowing through the fuel jumper line from the fuel manifold to the fuel injector.

2. The fuel line jumper assembly of claim 1 wherein said means for connecting said engine block and said fuel manifold comprises:

a bolt having a head;

a sealing washer formed with a metal washer and a rubber ring, wherein said bolt is placed through the center of said rings;

a flat steel washer having a opening wherein said bolt is placed through said opening and;

a beveled washer with the convex portion directed towards the bolt head whereby the beveled washer is flattened as the bolt is fastened to provide enhanced sealing against fuel leakage at the connection between said engine block and said fuel manifold.

3. The fuel jumper assembly of claim 1 wherein said injector is formed with a stud for insertion through said opening in said center opening of said fuel jumper block.

4. The fuel jumper assembly of claim 1 wherein said means for connecting said engine block and said fuel manifold to said fuel jumper block is a bolt and at least one integrated sealing washer with a metal ring and a rubber ring, fastened around said bolt.

5. A fuel line jumper assembly for use with a fuel injector having a protruding stud and an internal combustion engine block having a fuel manifold, said assembly comprising:

at least one fuel jumper line connected to at least one fuel jumper block;

means for fastening said fuel injector to said fuel jumper block;

first and second cone-shaped fittings which are formed at each opposing end of each of said at least one fuel jumper lines;

chamfer-shaped openings formed in the fuel injector to receive said first cone-shaped fittings;

chamfer-shaped openings formed in said fuel manifold to receive said second cone-shaped fitting;

a bolt having a head connecting said engine block to said fuel jumper block;

an integrated sealing washer having a metal washer molded to a rubber ring, placed around said bolt;

a beveled washer with the convex portion directed towards said bolt head whereby the beveled washer is flattened as the bolt is fastened to provide enhanced sealing against fuel leakage at the connection between said engine block and said fuel manifold.

6. The fuel jumper assembly of claim 5 wherein said jumper block has an opening to receive the injector stud.

7. The fuel jumper assembly of claim 5 wherein said bolt head is hexagonal.

8. The fuel jumper assembly of claim 5 further including a flat steel washer placed around said bolt.

9. The fuel jumper assembly of claim 5 wherein said flat steel washer is placed between said integrated sealing washer and said beveled washer.

10. The fuel jumper assembly of claim 5 wherein said injector stud is threaded and fastened to said jumper block with a nut.

* * * * *